US007104496B2

(12) United States Patent
Chang

(10) Patent No.: US 7,104,496 B2
(45) Date of Patent: Sep. 12, 2006

(54) ACTIVE PROTECTION DEVICE AND ASSOCIATED APPARATUS, SYSTEM, AND METHOD

(75) Inventor: Yu-Wen Chang, Rancho Palos Verdes, CA (US)

(73) Assignee: Chang Industry, Inc., La Verne, CA (US)

( * ) Notice: Subject to any disclaimer, the term of this patent is extended or adjusted under 35 U.S.C. 154(b) by 0 days.

(21) Appl. No.: 11/225,814

(22) Filed: Sep. 13, 2005

(65) Prior Publication Data

US 2006/0175464 A1 Aug. 10, 2006

Related U.S. Application Data

(63) Continuation-in-part of application No. 10/787,843, filed on Feb. 26, 2004.

(51) Int. Cl.
*F42B 15/01* (2006.01)
*F41G 7/00* (2006.01)
*G01S 13/00* (2006.01)

(52) U.S. Cl. ..... 244/3.19; 244/3.1; 244/3.11; 244/3.14; 244/3.15; 89/1.11; 102/400; 102/473; 102/475; 102/501; 342/52; 342/54; 342/61; 342/62

(58) Field of Classification Search ..... 89/1.11; 244/3.1–3.3; 102/400, 401, 405, 473–528; 342/13–15, 61–68, 104–115, 118, 119, 128–147, 342/175, 189–197, 52–58
See application file for complete search history.

(56) References Cited

U.S. PATENT DOCUMENTS 3,738,593 A * 6/1973 Duvall ..... 244/3.14
3,743,215 A * 7/1973 Harris ..... 244/3.14
3,883,091 A * 5/1975 Schaefer ..... 244/3.13
4,008,869 A * 2/1977 Weiss ..... 244/3.13
4,288,050 A * 9/1981 Gauggel ..... 244/3.16
4,347,996 A * 9/1982 Grosso ..... 244/3.16
4,492,166 A * 1/1985 Purcell ..... 244/3.22
4,898,341 A * 2/1990 Terzian ..... 244/3.16
4,922,827 A * 5/1990 Remo ..... 102/496
4,925,129 A * 5/1990 Salkeld et al. ..... 244/3.11
5,050,818 A * 9/1991 Sundermeyer ..... 244/3.15
5,071,087 A * 12/1991 Gray ..... 244/3.15
5,082,200 A * 1/1992 Gray ..... 244/3.15
5,112,006 A * 5/1992 Palmer ..... 244/3.16
5,340,056 A * 8/1994 Guelman et al. ..... 244/3.16
5,464,174 A * 11/1995 Laures ..... 244/3.11
5,620,152 A * 4/1997 Sargent ..... 244/3.12
5,662,291 A * 9/1997 Sepp et al. ..... 244/3.13

(Continued)

*Primary Examiner*—Bernarr E. Gregory
(74) *Attorney, Agent, or Firm*—Alston & Bird LLP

(57) ABSTRACT

An interceptor device for protecting a platform against an incoming threat is provided. The interceptor device comprises a housing and a countermeasure device. At least one detonating charge is capable of deploying the countermeasure device. A controller device housed by the housing is capable of directing the detonating charge(s) to deploy the countermeasure device at least partially radially outward of the housing, corresponding to the threat trajectory. A sensor device is in communication with the controller device, and comprises a range-finding apparatus including one of a LADAR, a RADAR, and a LIDAR device, capable of sensing the threat and/or a range thereof, at least partially radially outward of the housing, and notifying the controller device if the threat is sensed, to cause the controller device to direct the detonating charge(s) to deploy the countermeasure device to impact the threat in the intercept zone. Associated systems, and methods are also provided.

42 Claims, 9 Drawing Sheets

U.S. PATENT DOCUMENTS 5,671,138 A * 9/1997 Bessacini et al. ..... 244/3.13
5,671,140 A * 9/1997 Bessacini et al. ..... 244/3.13
5,696,347 A * 12/1997 Sebeny et al. ..... 244/3.15
5,710,423 A * 1/1998 Biven et al. ..... 244/3.1
5,804,812 A * 9/1998 Wicke ..... 244/3.1
5,828,571 A * 10/1998 Bessacini et al. ..... 244/3.15
5,862,496 A * 1/1999 Biven ..... 244/3.15
5,938,148 A * 8/1999 Orenstein ..... 244/3.15
5,944,762 A * 8/1999 Bessacini et al. ..... 244/3.13
5,987,362 A * 11/1999 Bessacini et al. ..... 244/3.13
6,006,145 A * 12/1999 Bessacini ..... 244/3.1
6,209,820 B1 * 4/2001 Golan et al. ..... 244/3.15
6,527,222 B1 * 3/2003 Redano ..... 244/3.14
6,543,716 B1 * 4/2003 Miller et al. ..... 244/3.21
6,568,628 B1 * 5/2003 Curtin et al. ..... 244/3.14
6,575,400 B1 * 6/2003 Hopkins et al. ..... 244/3.19
6,626,077 B1 * 9/2003 Gilbert ..... 89/1.11
6,626,396 B1 * 9/2003 Secker ..... 244/3.16
6,666,401 B1 * 12/2003 Mardirossian ..... 244/3.11
6,739,547 B1 * 5/2004 Redano ..... 244/3.14

* cited by examiner

ACTIVE PROTECTION DEVICE AND ASSOCIATED APPARATUS, SYSTEM, AND METHOD

CROSS-REFERENCES TO RELATED APPLICATIONS

This application is a continuation-in-part of copending U.S. patent application Ser. No. 10/787,843, filed on Feb. 26, 2004, which is hereby incorporated herein in its entirety by reference.

BACKGROUND OF THE INVENTION

1. Field of the Invention

The present invention relates to a defensive device and, more particularly, to an active protection device and associated apparatuses, systems, and methods.

2. Description of Related Art

High value strategic military platforms such as, for example, armored vehicles, amphibious assault vehicles, helicopters, gun boats, and the like, are subject to threats that can be generally categorized as follows:

i. Gun-fired Kinetic Energy (KE) long rod penetrators that are very high in speed, on the order of about 5,000 ft/sec or more, and are capable of piercing armor.

ii. Chemical Energy (CE) threats such as, for example, missiles and unguided rockets, including but not limited to Anti-Tank Guided Missiles (ATGM), HEAT (High Explosive Anti-Tank) rounds, and shoulder fired missiles, such as Anti-Aircraft type missiles, having a speed on the order of about 1,000 ft/sec to about 3,000 ft/sec.

iii. Shoulder-fired low cost CE threats such as, for example, Rocket Propelled Grenades (RPG) having a speed on the order of about 400 ft/sec.

In this regard, specific defensive countermeasure ("CM") techniques generally, and in theory, must be applied to defeat each respective type of threat. For example, a KE threat can be defeated by a fragmenting or blasting type of CM that can hit one or more critical locations of the KE rod penetrator so as to cause the penetrator to be diverted or otherwise disrupted so that the sharp tip thereof cannot penetrate the armor of the platform. In other instances, the CM can be configured to cause the KE rod penetrator to break up such that, in turn, the kinetic energy of each portion or fragment is reduced and becomes incapable of penetrating the armor of the platform. In still other instances, the flight trajectory of the KE threat can be diverted such that the threat is caused to miss the target platform. However, for CE threats, the warhead of the threat should be hit such that the warhead is asymmetrically detonated and thus becomes unable to form a penetrator or a penetrating jet typically characterizing such a threat, since simply destroying the body of the CE threat could still allow the penetrator formation and result in the piercing of the armor of and subsequent damage to the platform.

Certain protective weapon systems, either currently available or under development, may include a cuing sensor capable of searching for and detecting the threat over a particular angular sector with respect to the cuing sensor. In response to the detection of the threat, a projectile carrying a countermeasure is launched to intercept the CE threat. However, these protective weapon systems may not be particularly effective against an incoming CE threat since such systems may not be sufficiently accurate to ensure that the warhead section of the CE threat is actually hit and disabled or diverted. In addition, such protective weapon systems may also be incapable of intercepting and disabling a KE threat. Furthermore, the effectiveness of these weapon systems against multiple threats, as well as the capability thereof of discriminating against false targets, may be uncertain. Thus, there exists a need for a protective weapon system capable of being effective against both KE and CE threats, while having the capability of discriminating between actual threats and false targets, and having the capability, if necessary, of addressing multiple incoming threats. In some instances, a less complex configuration and/or construction of the interceptor device may be advantageous in terms of cost effectiveness, ease of construction/maintenance, and dependability.

BRIEF SUMMARY OF THE INVENTION

The above and other needs are met by the present invention which, in one embodiment, provides an interceptor device adapted to protect a platform associated therewith against an incoming threat, the threat having a trajectory, by intercepting the threat in an intercept zone. Such an interceptor device comprises a housing defining an axis and a countermeasure device operably engaged with the housing. At least one detonating charge is housed by the housing and is operably engaged with and capable of deploying the countermeasure device. A controller device is housed by the housing in communication with the at least one detonating charge. The controller device is configured to be capable of directing the at least one detonating charge to deploy the countermeasure device at least partially radially outward with respect to the axis of the housing and in correspondence with the trajectory of the threat. A second sensor device is operably engaged with the housing in communication with the controller device. The second sensor device comprises a range-finding apparatus including at least one of a laser detection and ranging device (LADAR), a radio detection and ranging device (RADAR), and a light detection and ranging device (LIDAR), configured to be capable of sensing one of the threat and a range thereof, at least partially radially outward of the housing, and notifying the controller device if the threat is sensed, so as to cause the controller device to direct the at least one detonating charge to deploy the countermeasure device to impact the threat in the intercept zone.

Another advantageous aspect of the present invention comprises a defensive weapon system adapted to protect a platform associated therewith against an incoming threat, the incoming threat having a trajectory, by intercepting the threat in an intercept zone. Such a weapon system includes a cuing sensor adapted to be capable of sensing the threat and an interceptor device in communication with the cuing sensor and adapted to be deployed in response to the threat sensed thereby. The interceptor device comprises a housing defining an axis and a countermeasure device operably engaged with the housing. At least one detonating charge is housed by the housing and is operably engaged with and capable of deploying the countermeasure device. A controller device housed by the housing is in communication with the at least one detonating charge, and configured to be capable of directing the at least one detonating charge to deploy the countermeasure device at least partially radially outward with respect to the axis of the housing and in correspondence with the trajectory of the threat. A sensor device is operably engaged with the housing in communication with the controller device. The sensor device comprises a range-finding apparatus including at least one of a laser detection and ranging device (LADAR), a radio detection and ranging device (RADAR), and a light detection and ranging device (LIDAR), configured to be capable of sensing one of the threat and a range thereof, at least partially radially outward of the housing, and notifying the controller device if the threat is sensed, so as to cause the controller device to direct the at least one detonating charge to deploy the countermeasure device to impact the threat in the intercept zone.

Yet another advantageous aspect of the present invention comprises a method of intercepting an incoming threat having a trajectory. First, an interceptor device is launched from a launching device so as to intercept the threat in an intercept zone, wherein the interceptor device includes a housing defining an axis and a countermeasure device operably engaged with the housing. At least one detonating charge is housed by the housing and is operably engaged with and capable of deploying the countermeasure device. A controller device is housed by the housing and is configured to be in communication with the at least one detonating charge. A sensor device is operably engaged with the housing in communication with the controller device. The sensor device comprises a range-finding apparatus including at least one of a laser detection and ranging device (LADAR), a radio detection and ranging device (RADAR), and a light detection and ranging device (LIDAR), configured to be capable of sensing one of the threat and a range thereof, at least partially radially outward of the housing, and notifying the controller device if the threat is sensed. The at least one detonating charge is then actuated with the controller device, in response to the sensor device, so as to deploy the countermeasure device at least partially radially outward with respect to the axis of the housing and in correspondence with the trajectory of the threat to thereby cause the countermeasure to impact the threat in the intercept zone.

To reiterate, embodiments of the present invention provide an interceptor device having certain advantageous features. For example, some embodiments implement a cuing sensor that is capable of, for instance, detecting the threat(s); discriminating the threat(s) from non-threats, such as small to medium caliber bullets and flying debris; determining the type of threat; calculating the threat flight path, including distance, speed, and angular position, to determine if the platform or vehicle to be protected will actually be threatened; timely directing the launch of an appropriate interceptor device to defeat the threat; and then destroying the threat upon impact, causing an asymmetric detonation of the threat, or otherwise disabling the threat. Accordingly, an interceptor device can be timely launched with an appropriate launch time and exit speed so to engage the threat at a pre-determined safe distance (otherwise referred to herein as the intercept zone) from the platform.

Further, in accordance with various embodiments of the present invention, the interceptor device is configured to implement one or more of several countermeasure ("CM") configurations so as to be capable of engaging and intercepting different types of threats. In one example ("Type A"), the countermeasure, when deployed by the detonating charge(s), forms a relatively large conical forward intercept zone that impacts and disables the threat when the threat enters the intercept zone. More particularly, the deployed CM is configured to impact the nose section of the threat in such a manner that formation of the warhead penetrator or penetrating jet, used by the threat to penetrate the armor of the platform, is defeated or otherwise disabled by the CM impact. With such a countermeasure, the interceptor device is preferably configured such that the back portion thereof will not fire backward and harm the platform to be protected when the CM is deployed by the detonating device(s). Such a "forward-looking" CM associated with the interceptor device will generally not require a fusing sensor (wherein such a fusing sensor will be described further herein) in instances where the interceptor device intercepts slow flying threats, such as an RPG. In such instances, the firing timing of the CM/detonating device(s) can be determined either by the cuing sensor, which may also be configured to track the outgoing interceptor while also tracking the incoming threat, or from the speed of the interceptor, whereby the CM/detonating device(s) may then be deployed through the use of, for example, a timing circuit onboard the interceptor device. For higher speed threats, such as an ATGM or other missiles having a speed of Mach one or higher, a forward-looking fusing sensor may be needed to provide proper countermeasure firing timing.

In another example ("Type B"), the CM, when deployed by the detonating device(s), generates a relatively broad band of outgoing particles which are directed radially outward of the interceptor device in order to hit the warhead section of a CE threat. Such a countermeasure may be used, for example, against a threat having a hardened area around the warhead section. The radially outgoing broad band or ring of particles covers a relatively large intercepting area having a minimum diameter of, for example, about 10 feet so as to thereby provide relatively broad protection for the platform against such a threat. The interceptor device will, in some instances, have onboard fusing sensors to determine the appropriate timing for actuating the detonating device(s) and deploying the CM. When deployed, the speed of the CM particles should preferably be as high as possible and, in some instances, preferably exceeding about 5,000 ft/sec.

In still another example ("Type C"), the CM, when deployed by the detonating device(s), generates a focused thin ring of outgoing CM particles. The resulting particles thus have highly concentrated power for hitting a single or multiple selected areas on the threat. Such a CM configuration is particularly advantageous and effective against a KE threat so as to, for example, cause the threat to break up and/or to be diverted. Such a CM should preferably be associated with, for instance, a fusing sensor or fusing sensor system on the interceptor device for accurately locating and determining the speed of the incoming threat in order for the CM be deployed so as to accurately hit the critical area(s) of the threat. Preferably, the speed of the radially outgoing CM particles must be as high as possible, in some instances exceeding about 10,000 ft/sec. In order to ensure a high or maximized impact power for the CM particles, the CM particles can be concentrated into one sector of the circular ring by using appropriate parameters such as, for example, the configuration and/or actuation procedure of the detonating device(s).

Thus, embodiments of the present invention meet the above-identified needs and provide significant advantages as detailed further herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 3B:
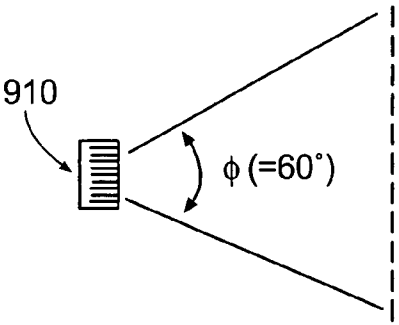
Figure 3C:
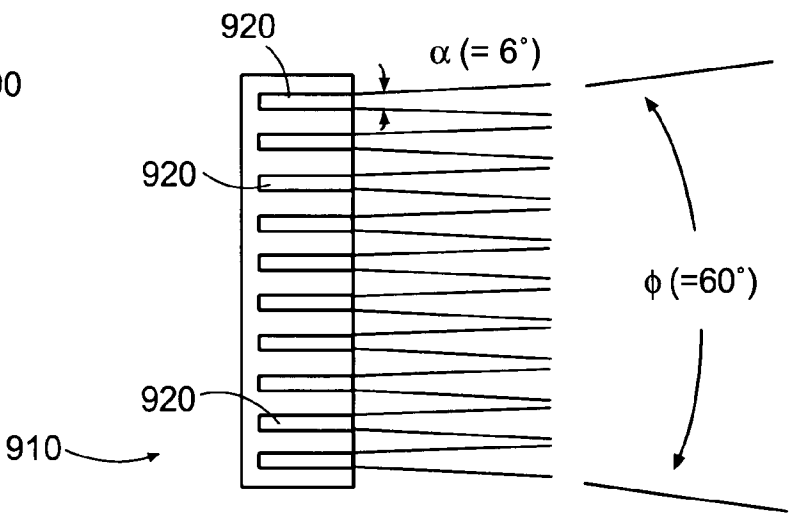
Figure 3A:
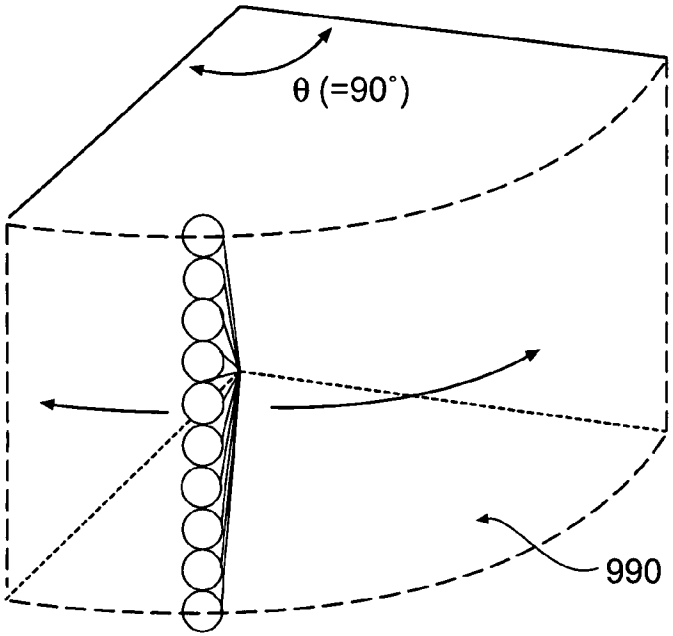
Figure 5B:
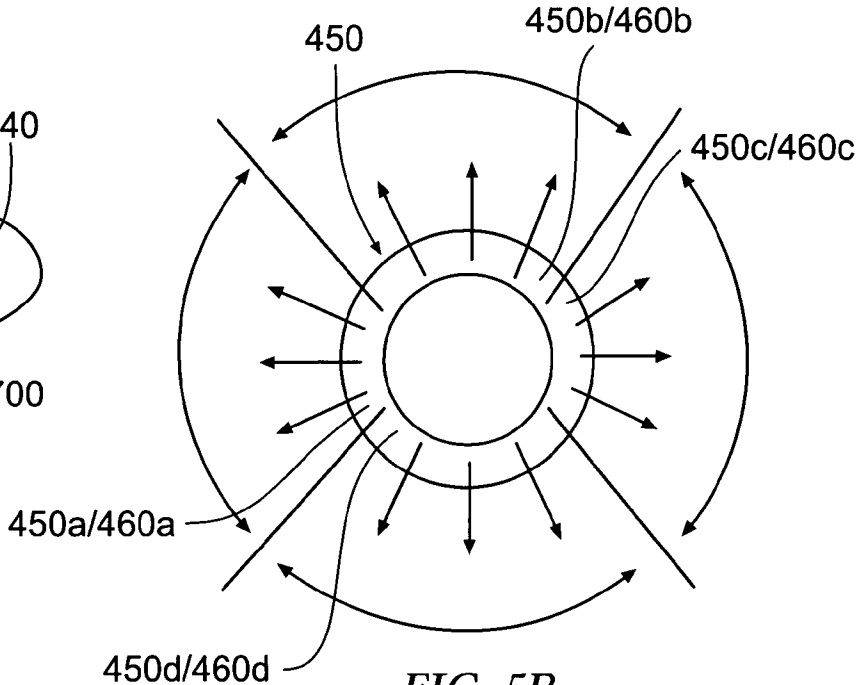
Figure 5A:
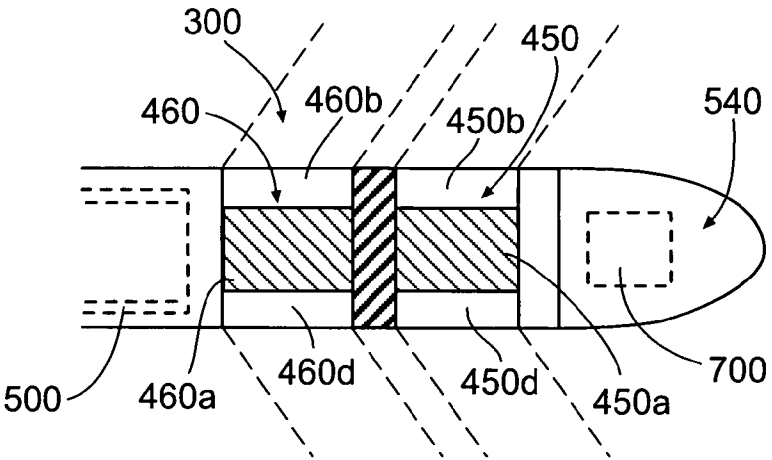
Figure 5C:
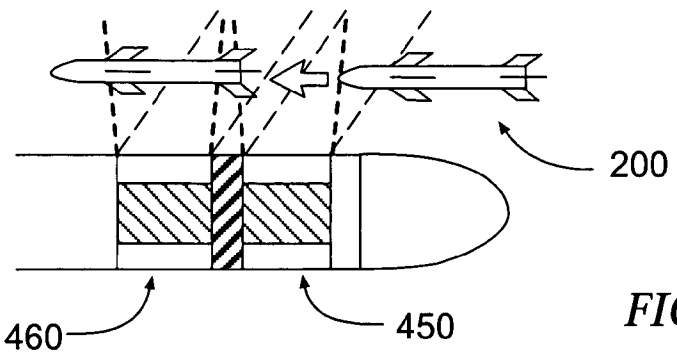
Figure 6A:
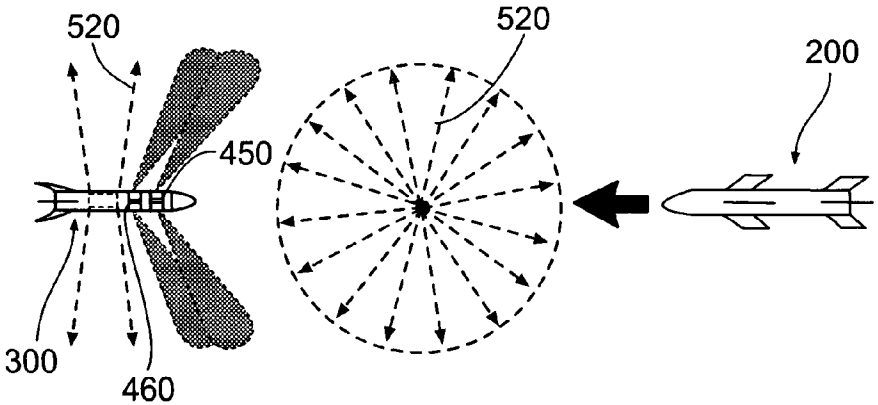
Figure 6B:
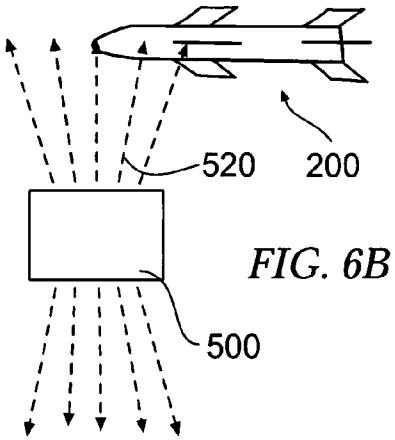
Figure 6C:
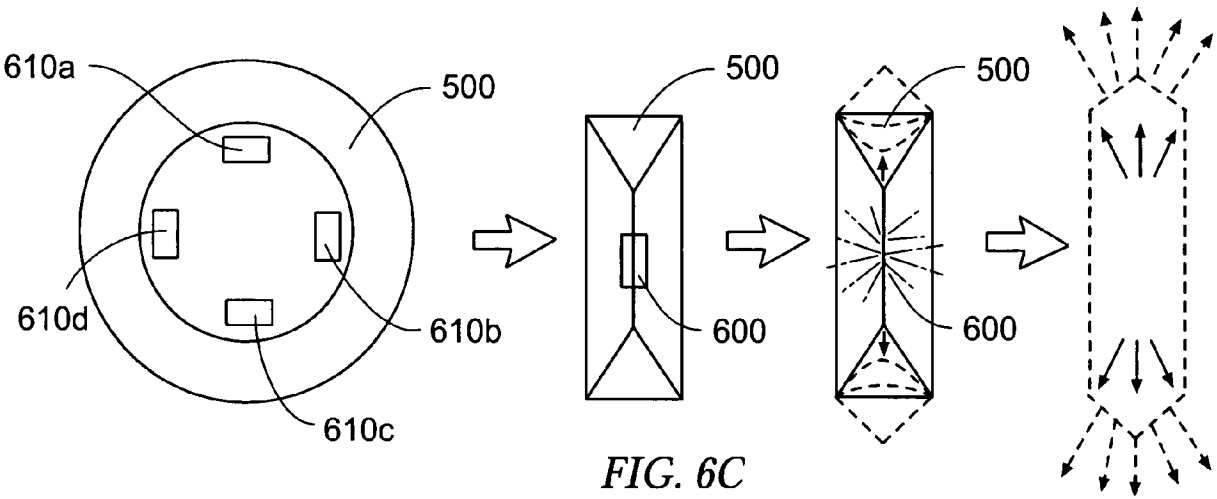
Figure 7A:
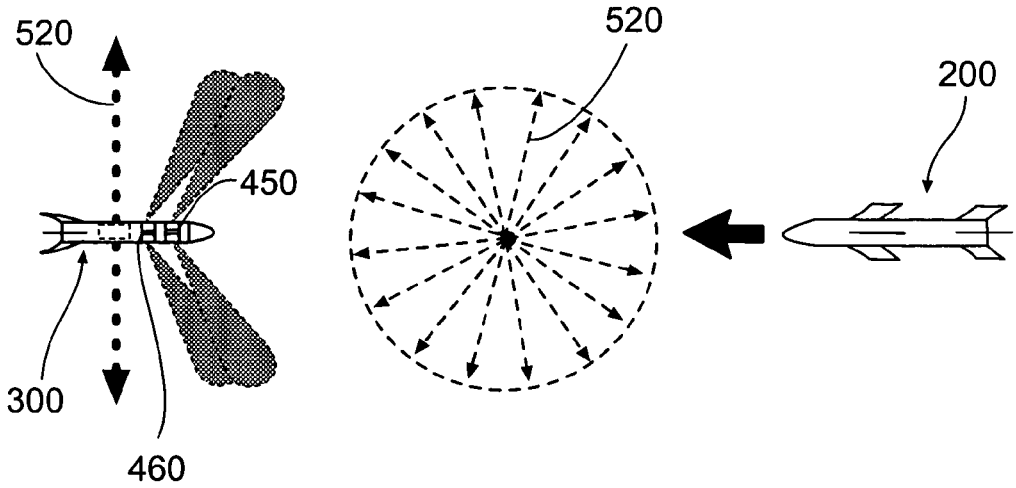
Figure 7B:
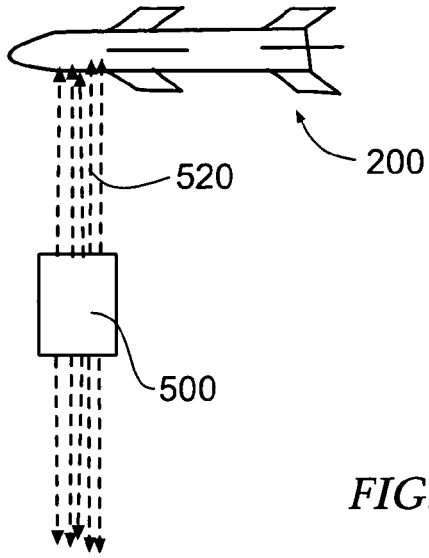
Figure 8B:
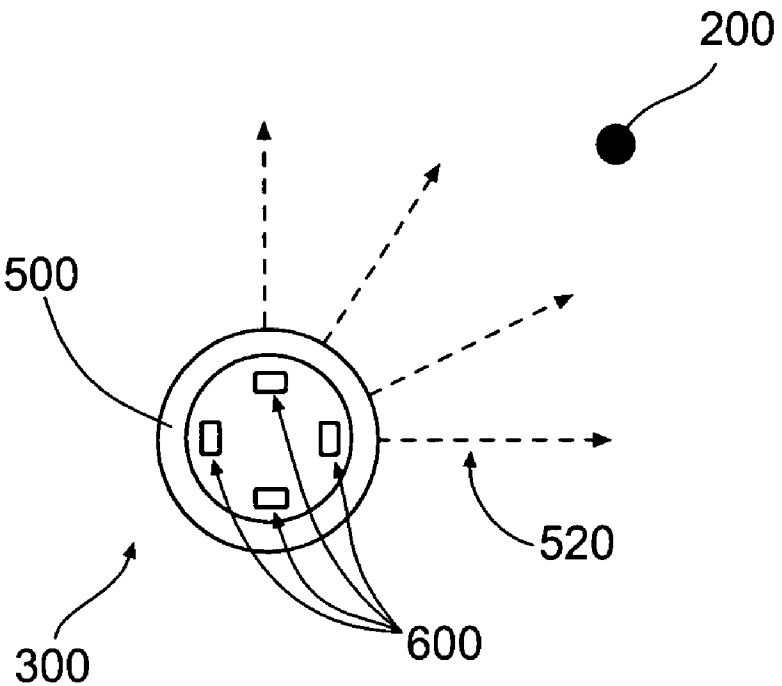
Figure 8A:
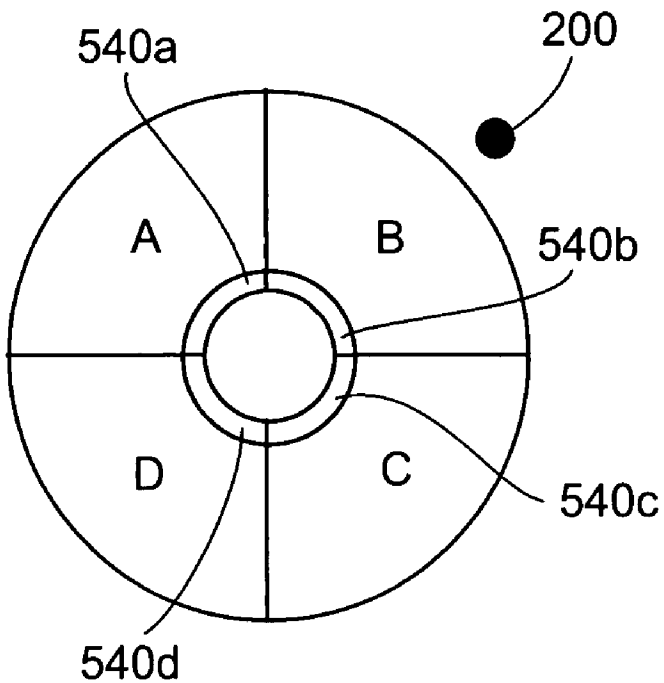

FIGS. 3A–3C schematically illustrate a cuing sensor implemented by an active protection system according to one embodiment of the present invention;

FIGS. 4A–4D schematically illustrate some examples of a deployed countermeasure forming a forward-expanding cone shape distribution of particles according to embodiments of the present invention;

FIGS. 5A–5C schematically illustrate an example of one or more cuing sensors disposed onboard an interceptor device according to one embodiment of the present invention;

FIGS. 6A–6C schematically illustrate another example of a deployed countermeasure forming a relatively narrow band of particles according to one embodiment of the present invention;

FIGS. 7A and 7B schematically illustrate another example of a deployed countermeasure forming a relatively focused or cutting band of particles according to one embodiment of the present invention; and FIGS. 8A and 8B schematically illustrate an asymmetric deployment of a countermeasure according to one embodiment of the present invention for emitting a higher concentration of particles in a particular direction.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
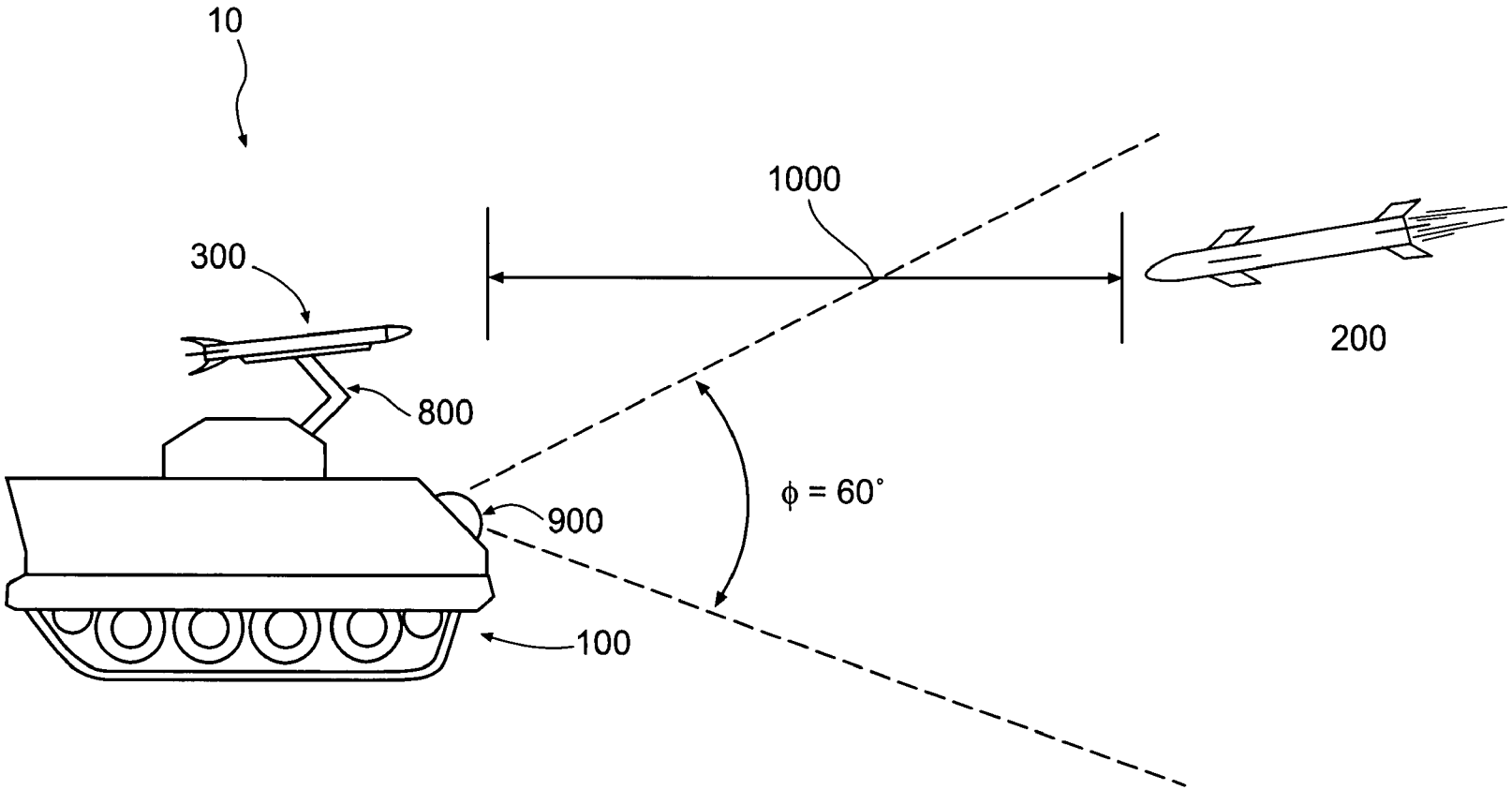
FIG. 1 is a schematic of an active protection device for protecting a platform against an incoming threat according to one embodiment of the present invention.

FIG. 1 illustrates an active protection system according to one embodiment of the present invention, the system being indicated generally by the numeral 10. Such a system 10, according to particularly advantageous embodiments of the present invention, is intended to protect a platform 100 against an incoming threat 200, wherein such a threat 200 may be, for instance, a chemical energy (CE) type or a kinetic energy (KE) type threat, as previously discussed, or any other type of threat 200 which may be addressed and intercepted by a system 10 as described herein or extensions or variants thereof within the spirit and scope of the present invention. Still further, the term "platform" as used herein is intended to be entirely nonrestrictive and may include, for example, a land-based vehicle such as a tank, troop carrier, or the like; an airborne vehicle such as a helicopter, an airplane (commercial, civilian, or military), an unmanned drone, or the like; or a waterborne vehicle such as a ship, submarine, or the like. However, the platform does not necessarily need to be a "vehicle," but may also comprise a building on land (such as a high-rise tower), a stationary rig at sea, or an orbiting satellite. In some instances, the system 10 may be embodied as a portable device capable of protecting, for example, a troop encampment or even an individual person. Thus, as used herein, the term "platform" is intended to encompass any person(s), place(s), or thing(s) which may be attacked by any of the threats 200 described herein or otherwise readily contemplated. Thus, one skilled in the art will readily appreciate that a system 10 according to the present invention may be used to protect many different "platforms" against incoming threats 200 and that the system 10 and concepts associated therewith, as described herein, may be extended to, modified, or otherwise alternatively configured to address many different types of threats 200, either existing or developed in the future.

Figure 2:
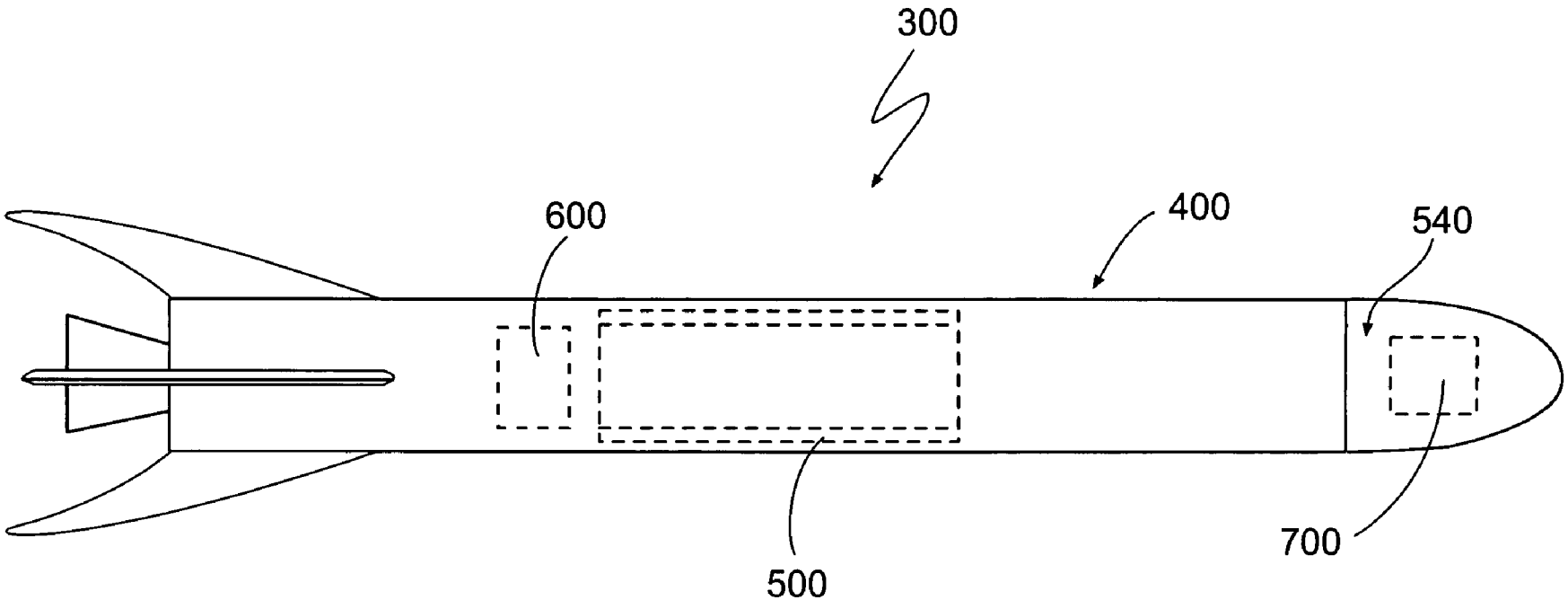
FIG. 2 is a schematic of an interceptor device according to one embodiment of the present invention.

In one embodiment, the system 10 comprises an interceptor device 300, as shown in FIGS. 1 and 2, wherein the interceptor device 300 generally includes a housing 400, a countermeasure ("CM") 500, one or more detonating devices 600, and a controller 700. In some embodiments, the interceptor device 300 has a launching device 800 and a cuing sensor (or "first sensor device") 900 associated therewith. In such embodiments, the cuing sensor 900 may be configured to, for example, detect the incoming threat 200 and direct the launching device 800 to launch the interceptor device 300 is response thereto. The cuing sensor 900 may be implemented in many different manners. For example, the cuing sensor 900 may be mounted on or in close proximity to the launching device 800, may be mounted in the interceptor device 300 itself, may be disposed remotely with respect to the launching device 800, or may be mobile within a certain range of the launching device 800. Further, the launching device 800/interceptor device 300 may be disposed remotely to and at a distance away from the platform 100 itself and does not necessarily have to be mounted to or in close proximity to the platform 100, as will be readily appreciated by one skilled in the art.

In embodiments of the present invention, the cuing sensor 900 is critical to the effectiveness of the system 10, and the parameters of the cuing sensor 900 are defined, at least in part, by the type of threat and a minimum knock-out distance ("MKOD") 1000 away from the platform 100 that the threat 200 can be intercepted. That is, the threat 200 must be intercepted at a distance of at least the MKOD 1000 from the platform 100, as shown in FIG. 1, in order for the desired level of protection to be provided. The MKOD 1000 may be determined from a variety of factors such as, for example, the sensitivity of the cuing sensor 900, the time necessary to actuate the launching device 800 to launch the interceptor device 300, the effectiveness and accuracy of the countermeasure 500, the acceleration and speed of the interceptor device 300, and the nature of the platform 100 to be protected. However, one skilled in the art will readily appreciate that many other factors may be used to determine an appropriate MKOD 1000. The cuing sensor 900 may comprise, for instance, a millimeter wave frequency (30–100 GHz) radar sensor or device that is capable of detecting the threat 200 within a relatively large defense zone 990 represented, for example, by a horizontal angular sector $\theta$ and a vertical angular sector $\phi$ where, for instance, $\theta$ may be about 90° and $\phi$ may be about 60°, as shown in FIGS. 3A and 3B. The defense zone 990 is configured to be relatively large since, in some instances, it may be desirable to be able to detect and protect the platform 100 against multiple threats 200 in and/or entering the defense zone 990. However, one skilled in the art will appreciate that, with a radar type sensor or device comprising the cuing sensor 900, a narrower radar beam is generally more advantageous for providing adequate and appropriate angular resolution $\alpha$ for detecting the threat(s), while also enhancing clutter rejection and false target rejection. Accordingly, in some embodiments, it is preferable that the cuing sensor 900 comprise a radar device having a relatively narrow radar beam. For example, if an angular resolution of $\alpha$=6° is determined to be desirable, then the defense zone 990 must be resolved horizontally into $\theta/\alpha=15$ resolution sectors and vertically into $\phi/\alpha=10$ resolution sectors.

A cuing sensor 900 capable of addressing such resolution sectors comprising the defense zone 990 can be provided by, for example, an array of simultaneously operable individual radar devices (an array of multiple fixed beams) with one radar device covering each resolution sector. However, in such instances, 15×10=150 radar devices would be necessary, possibly rendering such a configuration undesirably costly and impractical. In other instances, a phased array radar device having a plurality of radar elements may be implemented, with each element being capable of generating a beam. The elements are configured and selectively actuated within the phased array radar device such that the device effectively produces a single beam having a beam width of $\alpha=6°$ at, for example, a frequency of about 60 GHz and a wavelength $\lambda$ of about 0.2 inches, that can be "scanned" through the defense zone 990. Further, since an optimal phased array radar device requires an element spacing of about ½ wavelength, or about 0.1 inches, about $(2/0.1)^2=400$ elements would be required for the described configuration, wherein such a configuration may be undesirably costly and difficult to construct. In addition, since only a single beam is used for scanning the defense zone 990, the dwell time of each beam on the target or threat from the phased array radar device will be reduced by 150 times as compared to the array of multiple fixed beams. Assuming that each radar element in the phased array radar device has substantially the same transmitter power and receiver noise characteristics so as to produce a consistent scanning beam, the phased array radar device will be less sensitive by 150 times as compared to the array of multiple fixed beams. In some instances, in order to compensate for this reduction in sensitivity, the transmitter power of each radar element may be increased by 150 times. However, the overall complexity associated with a millimeter wave phased array radar device in terms of, for example, phase adjustment, cost associated with phase shifters, and lengthy phase adjustment and set-up requirements, may also render such a phased array radar device impractical in some instances.

Though the present invention does not necessarily preclude the implementation of such cuing sensors 900 as described above, particularly advantageous embodiments of the present invention use a cuing sensor 900 comprising a single linear array 910 of radar devices 920, as shown in FIG. 3C, wherein such a linear array 910 may be, for example, a vertical array of 10 individual radar devices 920 each having a beam width of $\alpha=6°$ so as to be capable of covering the vertical angular sector $\phi=60°$. Note that, though values are provided, for instance, for beam width, angular sectors, ranges, and the like, the provided values are for the sake of example only and are not intended to be limiting or restricting with respect to the implemented values. The linear array 910 can then be fast-scanned or swept in a side-to-side motion in the horizontal direction by, for example, a mechanical type mechanism, such that the radar devices 920 are able to scan the large horizontal angular sector $\theta=90°$. The beam dwell time for this configuration, and thus the sensitivity, will be reduced by only 15 times in comparison to the starring array, though this reduction in sensitivity may be compensated for by, for example, increasing the transmitter power for each radar device 920 by 15 times. In embodiments implementing the scanning single linear array 910, the radar devices 920 may be configured to operate at millimeter wave frequencies of, for example, about 60 GHz. The operational frequency of about 60 GHz is advantageous since, as will be appreciated by one skilled in the art, the oxygen absorption or attenuation factor of the atmosphere is about 16 db/km at about 60 GHz. Accordingly, it will be difficult, if not practically possible, to intercept the beams produced by the radar devices 920 beyond a distance of about 1 km away from the cuing sensor 900. As such, it may be difficult, if not practically possible, to jam the cuing sensor 900 from a distance greater than about 1 km away therefrom. For the sake of example, such a configuration of the cuing sensor 900 may be capable of initially detecting the threat 200 ("the initial threat detection range") up to about 1,000 ft from the platform 100 (presuming that the cuing sensor 900 is in close proximity to the platform 100). The radar devices 920 may also be configured to operate at other frequencies, higher or lower than 60 GHz, depending on many different factors such as, for example, the radar cross section ("RCS") of the threat 200, the speed of the threat 200, and the required MKOD 1000, so that, in those instances, a slightly longer initial threat detection range may be achieved. In some instances, an advantage of using radar devices 920 configured to operate in a millimeter wave regime is the size of the antenna required for such devices 920. For example, with a beam width of $\alpha=6°$, the antenna aperture of $D\approx(\lambda/\alpha)(180/\pi)\approx2$ inches in size, as will be appreciated by one skilled in the art. As such, the size of the antenna for the linear array 910 of the 10 radar devices 920 may be on the order of as low as several square inches in area.

In one embodiment, the radar devices 920 of the linear array 910 may be configured, for example, to use an ultra-linear frequency modulated continuous wave ("FMCW") modulation waveform, as will be appreciated by one skilled in the art. An FMCW modulation waveform is generally capable of providing a high range resolution, for instance, on the order of, for example, less than about 6 inches when used with a sufficiently capable radar device 920. Further, in some instances, microcircuits such as, for example, millimeter wave monolithic integrated circuit ("MMIC") devices, may be used for at least some of the components of each radar device 920 such as, for instance, radar transmitter and receiver components and signal processor devices, thereby allowing the radar devices 920 to be relatively small in size. Thus, one of the advantageous results of such a configuration will be a small, high performance, and low cost multi-beam scanning radar device comprising the cuing sensor 900. One skilled in the art will appreciate, however, that the first sensor device or cuing sensor 900, or any of the individual radar devices 920, more generally comprises a range-finding apparatus configured to sense an object as well as determine a range thereof. Accordingly, any such range-finding apparatus may comprise, for example, any one or more of a laser detection and ranging device (LADAR), a radio detection and ranging device (RADAR), and a light detection and ranging device (LIDAR), wherein such range-finding apparatuses may be configured to operate in any appropriate spectrum or at any appropriate frequency, using any appropriate signal-generating and/or signal-detecting mechanism. For example, an appropriate signal for such a range-detecting apparatus may be generated in the millimeter wave range or the microwave range, or in the infrared spectrum or the visible light spectrum, while the signal-generating mechanism may comprise a laser or a light-emitting diode (LED). Accordingly, one skilled in the art will appreciate that the examples presented herein are not intended to be limiting in any manner.

An advantageous cuing sensor 900, as described above for certain embodiments of the present invention, must have the particular capabilities for sufficiently monitoring the defense zone 990 so as to provide an effective system 10. For example, a complete horizontal beam scan of the cuing sensor 900 through the defense zone 990 can be designated to take a certain time t, while the beam produced by each radar device 920 has a beamwidth $\alpha$ and the total horizontal angular sector covered by the linear array 910 is $\theta$. Thus, the time that each beam will dwell on a threat 200 within the defense zone 990 will be $t\alpha/\theta$ and, if the speed of the threat 200 toward the protected platform 100 is $v_T$, the threat 200 will advance a distance of $tv_T$ toward the platform 100 during that time t. For certain purposes such as, for example, threat discrimination, a number of complete scans N of the horizontal angular sector $\theta$ may be preferred. During these N scans, the threat 200 will advance a distance of $Ntv_T$ toward the platform 100. If, for example N=10, then the threat 200 can be detected and analyzed 10 times with respect to, for instance, range and angle of approach, during the distance $Ntv_T$. After these N scans, if the approaching threat 200 is determined to be actually threatening to the platform 100, the launching device 800 is then actuated to launch the interceptor device 300 to intercept the threat 200 at a certain distance $d_{intercept}$ from the platform 100, wherein the distance $d_{intercept}$ is at least the MKOD 1000 (or any other selected larger distance from the platform 100). Though not discussed in detail herein, one skilled in that art will readily appreciate that many different methods may be implemented for discriminating whether the threat 200 presents an actual hazard to the platform 100. For example, without limiting the range of possible discrimination methodologies, radar profiles for known threats may be empirically determined and provided in a reference database for the cuing sensor 900 or the cuing sensor 900 may be configured to detect a particular range of threat speeds corresponding to a certain class of threat.

In some instances, the interceptor device 300 may have a small launch delay time $t_{delay}$ due to, for example, the launch sequence and procedure of the launching device 800, whereafter the interceptor device 300 is launched from the launching device 800 with a particular exit velocity $v_{exit}$ (also referred to herein as the intercept velocity of the interceptor device 300). Accordingly:

$$t_{delay}+d_{intercept}/v_{exit}=D/v_T \quad (1)$$

Note that, due to a relatively short distance traveled by the threat under these various scenarios, a constant threat velocity $v_T$ is presumed, while D represents the distance that the threat 200 travels before being intercepted. As such, following from the foregoing analysis, the cuing sensor 900 will initially detect and begin to track the threat 200 at a distance:

$$D_1=Ntv_T+D+d_{intercept} \quad (2)$$

The launching device 800 will be actuated to launch the interceptor device 300 when the threat 200 is at a distance:

$$D_2=D+d_{intercept} \quad (3)$$

and the interceptor device 300 will thus intercept the threat 200 at a distance:

$$D_3=d_{intercept} \quad (4)$$

In some embodiments of the present invention, it may be advantageous to have the distance $D_1$ as short as possible since, in general, the cuing sensor 900 will have more difficulty discriminating between the actual hazardous threats and non-threats as the distance $D_1$ increases. In terms of practical considerations, a platform 100 will likely be unable to carry an unlimited supply of interceptor devices 300 and, in all likelihood, will be limited to a particular amount thereof. As such, an interceptor device 300 is desirably launched only when necessary. Thus, in order to minimize the distance $D_1$, the distance D must also be minimal, wherein such a condition can be achieved with a fast intercept or exit velocity $v_{exit}$, since the launch delay time $t_{delay}$ is typically small or substantially negligible. In some instances, the magnitude of the exit velocity $v_{exit}$ may need to be evaluated with respect to the configuration of platform 100 to which the launching device 800 is mounted so that, for example, the recoil force from the launching the interceptor device 300 or any backward projected particle from the deployed CM 500 will not damage the platform 100.

Another advantageous aspect of the present invention comprises the configuration of the interceptor device 300. For example, advantageous embodiments of the interceptor device 300 each include a countermeasure 500 configured to deployed therefrom so as to intercept the threat 200, the countermeasure 500 being further configured to provide a relatively large intercept area so as to, for instance, allow one interceptor device 300 to be capable of protecting a large surface area of the platform 100. As further described herein, the configuration of the countermeasure 500 may also be particularly tailored to the type of threat 200 to be intercepted and disabled, wherein many parameters such as, for example, accurate timing when deploying the CM 500, as well as the outward velocity and distance traveled by the deployed CM 500, must also be considered.

Figure 4A:
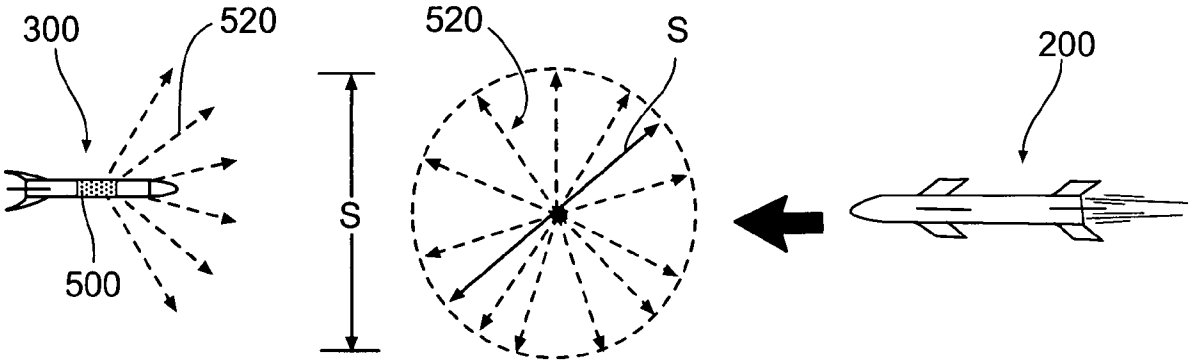
Figure 4B:
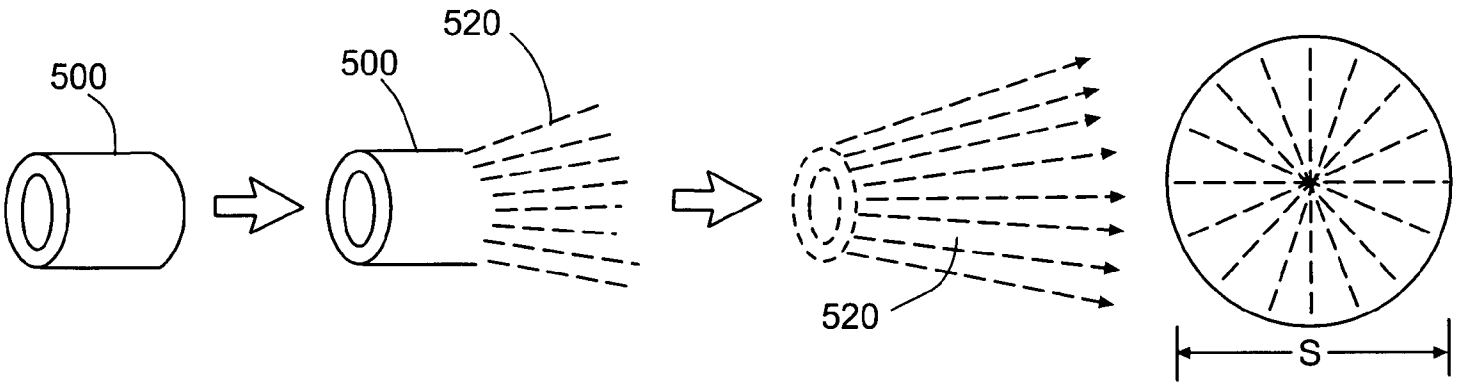
Figure 4C:
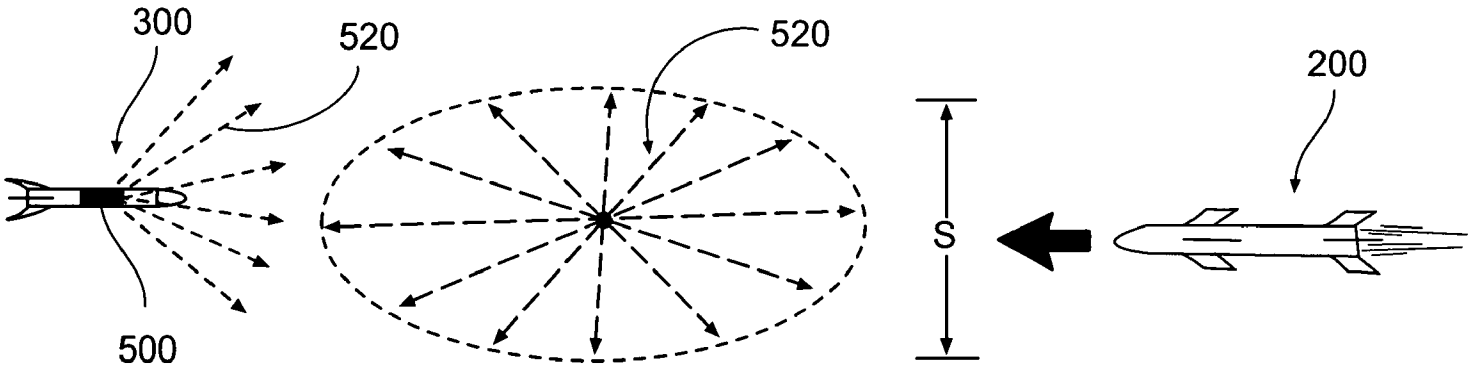
Figure 4D:
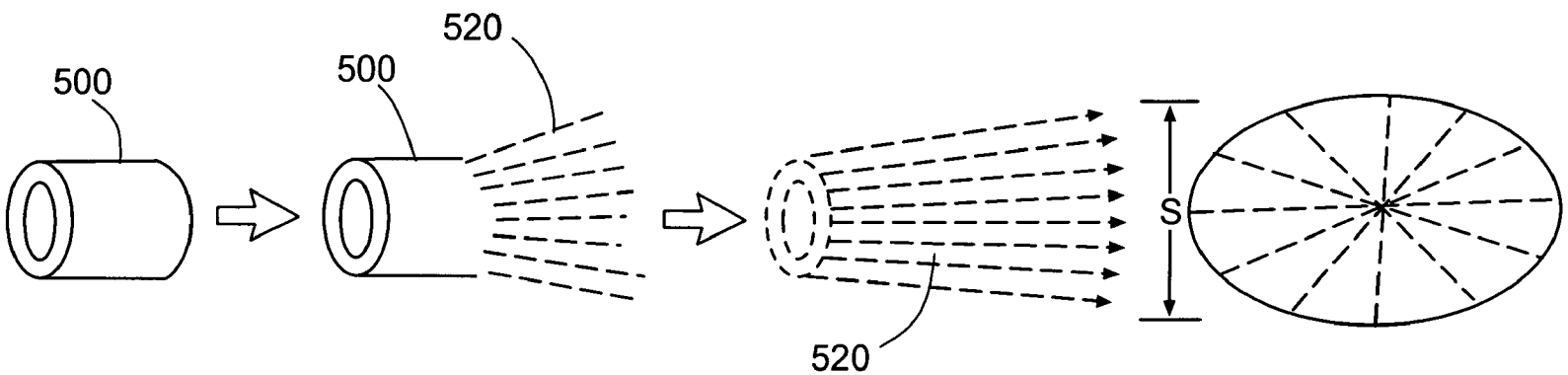

In one advantageous embodiment, the CM 500 may be configured to produce, when deployed by the one or more detonating devices 600, a band of forward and outwardly projecting particles 520 having, for example, an increasing circular cross-section, as shown in FIGS. 4A and 4B, or an increasing elliptical cross-section, as shown in FIGS. 4C and 4D (in other words, a cone having substantially circular or elliptical cross-section, the cross-section increasing in size in the direction of flight of the interceptor device 300). A CM 500 configured in this manner must still produce a sufficient particle density over a relatively large conical volume so as to be effective in intercepting the threat 200 and to increase the likelihood that the threat 200 is actually hit by the particles 520. The relative speed between the threat 200 and the interceptor device 300, as well as the forward and radially outward projection or speed of the particles 520, produces a large relative impact velocity and momentum between the particles 520 and the threat 200 when the threat 200 is intercepted. In such embodiments, the one or more detonating devices 600 are configured to deploy the CM 500 such that particles 520 produced by the CM 500 hits the threat 200 at or about the warhead section thereof. A CM 500 having such a configuration is particularly suited for intercepting relatively "soft-shelled" CE threats 200 such as, for example, an RPG, an ATGM, or various shoulder-fired missiles.

One skilled in the art will appreciate that the required parameters for the particles 520 produced by the CM 500 may be readily determined and implemented in a particular CM 500. For example, in some instances, an appropriate requirement for the CM 500 may be defined by the number of particles 520 required to extend over a particular surface area (assuming about equal velocity of the particles 520) defined by a diameter S, while providing particle spacing of less than the general diameter of the threat 200. In order to obtain the described "cone-shaped" configuration of the deployed CM 500, the CM 500 may be configured as, for example, a cylinder disposed along the axis of the interceptor device 300, in one instance between the one or more detonating devices 600 at the rear and a nosepiece 540 at the front of the interceptor device 300, though the one or more detonating devices 600 may be disposed where necessary about the interceptor device 300 so as to obtain the necessary deployment characteristics of the CM 500. One skilled in the art will further appreciate that the housing 400 may be disposed about the CM 500, within the CM 500, or may actually comprise the CM 500, and is generally configured to house the one or more detonating devices 600 and the controller 700. As such, since the one or more detonating devices 600 is configured to actuate the deployment of the CM 500 from the rear of the interceptor device 300, one skilled in the art will appreciate that the detonation of the one or more detonating devices from the rear of the interceptor device 300 will propagate toward the front of the interceptor device 300 within the cylindrical CM 500. Thus, actual deployment of the CM 500 occurs when the detonation reaches the nosepiece 540 and, since the forward end of the CM 500 is first deployed by the detonation, the deployed CM 500 forms the described "cone shaped" configuration with the larger diameter of the cone being toward the front end of the interceptor device 300. Of course, one skilled in the art will readily appreciate that a cone having a circular cross-section may be formed where the one or more detonating devices 600 configured symmetrically detonate a likewise symmetrical CM 500. However, in instances where an elliptical cross-section is desired (for example, to increase the width of the protected area preceding the platform 100 since the threat 200 is more likely to have more lateral variance on approach to the platform 100 than vertical variance), the one or more detonating devices 600 may be configured to, for example, provide a greater lateral deployment force on the CM 500 or the CM 500, in some instances, may be configured such that the particles 520 travel farther laterally such as, for example, by appropriately varying the thickness of or material comprising the CM 500. However, one skilled in the art will understand that the variance in shape of the deployed particles 520 may be accomplished in many different ways consistent with the spirit and scope of the present invention.

Another important factor in determining the effectiveness of a system 10, according to some embodiments of the present invention, is the timing with respect to deploying the CM 500. The cuing sensor 900 is generally discretely disposed with respect to the interceptor device 300 (though embodiments of the present invention distinctly contemplate that a cuing sensor 900 may be directly associated with the interceptor device 300, if such a configuration is determined to be desirable). However, in any instance, even after the interceptor device 300 has been launched by the launching device 800, the threat 200 will continue to be tracked by the cuing sensor 900. One skilled in the art will readily appreciate that the cuing sensor 900 may also have extensive electronic componentry associated therewith, the componentry making the cuing sensor 900 capable performing or directing certain procedures as a result of the detection of an incoming threat 200. Such componentry may include, for example, a signal processor device (not shown) capable of calculating, for instance, the relative velocity and range of the threat 200, from the known velocity of the interceptor device 300, based on input from the cuing sensor 900. The cuing sensor 900 is also capable of simultaneously tracking the position and velocity of the launched interceptor device 300 and, in some instances, may provide a signal or directive to the interceptor device 300, via the controller 700, for the one or more detonating devices 600 to deploy the CM 500. Such a signal from the cuing sensor 900 may be provided to the controller 700 on the interceptor device 300, for example, through a secure wireless link or via a wire connected between the cuing sensor 900 and the interceptor device 300.

In some embodiments, such as described where the interceptor device 300 is launched against a relatively slow CE threat 200, the controller 700 and/or the one or more detonating devices 600 may be provided and/or configured with a fixed post-launch time delay before deploying the CM 500, generally under the assumption that the outgoing speed of the interceptor device 300 is relatively constant or otherwise known. Another advantage of such embodiments, where the CM 500 is deployed as directed by the cuing sensor 900, is that the cuing sensor 900, whether disposed on or separately from the platform 100, can use various threat discrimination schemes such as, for example, Moving Target Identification ("MTI"), implementing a Doppler technique for separating the threat 200 from any proximate ground clutter. Generally, the interceptor device 300 can be launched with the platform 100 stationary or in motion, since a ground- or water-based platform 100 typically moves at much lower speed than the threat 200. However, such an interceptor device 300 may also be launched from an airborne platform 100 though, in such instances, the cuing sensor 900 generally will not have to discriminate the threat 200 from ground clutter and, as such, may not need to implement MTI for clutter rejection. As described, such embodiments of the present invention may also provide an interceptor device 300 having relatively simple construction as well as lower cost since an onboard sensor(s) and extensive and complex electronic componentry are not required.

In some instances, the incoming threat 200 may be, for example, moving at such a high speed, that deploying the CM 500 based on a timing sequence or on the directive of the cuing sensor 900 may not be sufficiently accurate for effectively intercepting the threat 200. Accordingly, in some advantageous embodiments of the present invention, the interceptor device 300 may also include at least one fusing sensor 450 onboard of the interceptor device 300, wherein the at least one fusing sensor 450 may be disposed, for example, forward of the CM 500 in the nosepiece 540, or between the CM 500 and the nosepiece 540, as shown in FIGS. 5A–5C. The at least one fusing sensor 450 may comprise, for example, an appropriate millimeter wave frequency (30–100 GHz) radar device as previously discussed, and is essentially configured to form a "side-looking" sensor for detecting the threat 200 within a radial proximity to the interceptor device 300 and, in response thereto, forwarding an appropriate signal or directive to the controller 700 to actuate the one or more detonating devices 600 to deploy the CM 500. In some instances, that at least one fusing sensor 450 may comprise a plurality of fusing sensors disposed around the axis of the interceptor device 300, where four fusing sensors 450*a*, 450*b*, 450*c*, and 450*d* are shown in this instance, with each fusing sensor 450*a*, 450*b*, 450*c*, and 450*d* being configured to monitor a particular sector (such as, for example, a 90° sector in this example) about the interceptor device 300, wherein, in some embodiments, the fusing sensors 450*a*, 450*b*, 450*c*, and 450*d* are configured and arranged to cover the full 360° field around the interceptor device 300.

In addition to being arranged so as to be capable of covering the 360° field around the interceptor device 300, the interceptor device 300 may also have the at least one fusing sensor 450 and an additional at least one fusing sensor 460 (collectively "second sensor device" or "sensor device") configured and arranged in spaced apart relation along the axis thereof. Such a configuration is indicated, for example, by the additional row of fusing sensors 460*a*, 460*b*, 460*c*, and 460*d*. As previously discussed, one skilled in the art will appreciate that the second sensor device or any one of the at least one fusing sensor 450, 460 more generally comprises a range-finding apparatus configured to sense an object as well as determine a range thereof. Accordingly, any such range-finding apparatus may comprise, for example, any one or more of a laser detection and ranging device (LADAR), a radio detection and ranging device (RADAR), and a light detection and ranging device (LIDAR), wherein such range-finding apparatuses may be configured to operate in any appropriate spectrum or at any appropriate frequency, using any appropriate signal-generating and/or signal-detecting mechanism. For example, an appropriate signal for such a range-detecting apparatus may be generated in the millimeter wave range or the microwave range, or in the infrared spectrum or the visible light spectrum, while the signal-generating mechanism may comprise a laser or a light-emitting diode (LED). Accordingly, one skilled in the art will appreciate that the examples presented herein are not intended to be limiting in any manner.

The arrangement of the fusing sensors 450*a–d* and 460*a–d* spaced apart along the interceptor device 300 thus allows the range and relative velocity of the detected threat 200 to be determined by, for example, the controller 700 onboard the interceptor device 300. In some instances, the fusing sensors 450*a–d* and 460*a–d* are mounted to be somewhat canted toward the forward end of the interceptor device 300 and, in such a configuration, are capable of, for instance, providing the necessary "side-looking" function as well as a partially forward-looking function for earlier detection of the threat 200, such that separate sensors for the forward-looking function are not required. Such a configuration is particularly useful against, for example, a faster CE threat 200 such as an ATGM or shoulder-fired missile. For a slower CE threat 200 such as an RPG, the fusing sensors 450*a–d* and 460*a–d* may be configured to perform just a side-looking function (directed only radially outward of the interceptor device 300) in instances where the interceptor device 300 is also relatively slow, but the deployment speed of the CM 500 is relatively high (note that in this instance, since the threat 200 is a "soft-shelled" RPG, the CM 500 may also be configured to produce relatively small particles 520 upon deployment, as will be appreciated by one skilled in the art from the discussion herein).

In some instances, instead of being merely "soft-shelled," the threat 200 may have a hardened warhead section that may not necessarily be disabled or destroyed by a forward-expanding cone-shaped CM 500 as previously described. In such instances, the hardened warhead section is more effectively intercepted if hit directly (destroyed) or within sufficient proximity (disabled) so as to, for example, divert the warhead from a trajectory toward the platform 100. Accordingly, some embodiments of the present invention utilize a CM 500 configured to, upon deployment by the one or more detonating devices 600, concentrate the particles 520 into a relatively narrow radially outgoing band, as shown in FIGS. 6A–B. In such a configuration, the cuing sensor 900 directs the interceptor device 300 on a proper trajectory to intercept the threat 200, while the onboard fusing sensors 450, 460 spaced apart along the axis of the interceptor device 300 are configured to actually detect the threat 200 within proximity to the interceptor device 300 and then calculate the range and relative velocity of the threat 200 with respect thereto. Since the CM 500 has a known radially outward velocity and radial effective distance when deployed, the onboard controller 700 can then determine, from the data provided by the onboard fusing sensors 450, 460, the appropriate moment to actuate the one or more detonating devices 600 to deploy the CM 500 to engage the threat 200. Thus, an additional advantage of the forward-canted fusing sensors 450, 460 is to allow the CM 500 to be deployed substantially directly radially outward of the interceptor device 300 such that the particles 520 are directed along the shortest path outwardly of the interceptor device 300 to engage the threat 200.

One skilled in the art will readily appreciate that a CM 500 capable of forming a relatively narrow band of radially outgoing particles 520 may be achieved in many different manners. For example, as shown in FIG. 6C, the CM 500 may be configured as "shape charge" in the form of a ring having a triangular radial cross-section. In such instances, the actuation of the one or more detonating devices 600 serves to deploy the CM 500 by essentially inverting the cross-section of the CM 500 from the interior thereof to form the band of radially outgoing particles 520. In this example, four detonating devices 610*a*, 610*b*, 610*c*, and 610*d* may be provided, with each detonating device 610*a–d* being disposed about the interior of the CM 500 so as to deploy a separate quadrant of the CM 500 when actuated. Further, in this instance, the CM 500 is configured to be deployed, with timing as determined by the controller 700 via the fusing sensors 450, 460, as a relatively narrow band of particles 520, wherein the particles 520 are deployed with the intention of engaging or striking the threat 200 at or about the warhead section thereof so as to ensure asymmetric detonation of the warhead or diversion of the warhead from a trajectory toward the platform 100. Since the CM 500, in this instance, is deployed as a relatively concentrated band of particles 520 for impacting the threat 200 over a certain area, the CM 500 can be configured to produce larger sized particles 520 (as compared to the forward-expanding cone-shaped CM 500 which uses a smaller particle size for maximizing the probability of the threat 200 being impacted by one or more of those particles 520) for maximizing damage to the hardened warhead of the threat 200.

According to some embodiments of the present invention, the physical size of the interceptor device 300 may be relatively small such as, for example, on the order of between about 2 inches and about 4 inches in diameter. As such, the fusing sensors 450*a–d* and 460*a–d* are also of appropriate size to be effectively incorporated into the interceptor device 300 while still providing the required performance. That is, the fusing sensors 450, 460 are desirably configured to generate a narrow beam so as to provide the necessary resolution for detecting any incoming threats and, if the fusing sensors 450, 460 comprise, for example, appropriate millimeter wave frequency (30–100 GHz) radar devices, such a narrow beam is obtained while the antenna size is suitably small to meet the size criteria for a small interceptor device 300. More particularly, in the case of, for instance, a 60 GHz radar device, a 6° beam will require an antenna length of about 2 inches along the axis of the interceptor device 300, which is sufficient to meet the size requirements for a small interceptor device 300. In addition, at the 60 GHz frequency, the radar devices comprising the fusing sensors 450, 460 will advantageously be very difficult to be detected, intercepted, or jammed due to the aforementioned large atmospheric attenuation factor at about that frequency. Further, for a particular range from the interceptor device 300, such millimeter wave frequency radar devices are generally operable and unaffected by atmospheric factors such as, for example, weather conditions.

Another advantageous aspect of the present invention is directed to the interception of a particular threat 200 comprising, for example, a KE "long rod penetrator" device, which is generally difficult to intercept and destroy or otherwise disable. As previously discussed, a KE threat 200 is typically characterized by a relatively high speed, on the order of about 5,000 ft/sec, and uses the kinetic energy of the device, upon striking the intended target, in order to form the armor-piercing penetrator component of the device. Further, in order to for the penetrator component to achieve the maximum effect, a precise impact trajectory is often required. As such, one manner of intercepting, destroying, or otherwise disabling such a KE threat 200 is to impact one or more particular portions of the long rod so as to cause the device to break, tilt, tumble, or otherwise be disrupted from the intended trajectory toward the platform 100 so as to, for example, destroy the threat 200, divert the threat 200 away from the platform 100, disrupt the intended formation of the penetrator component, or reduce the penetration capabilities of the penetration component to below the level necessary to penetrate the armor about the platform 100.

In order to be effective against a KE threat 200, the interceptor device 300 must be capable of being rapidly deployed and should attain a sufficiently high velocity so as to be capable of intercepting the threat 200 at a sufficient distance from the platform 100. For example, in some instances, the interceptor device 300 may have a velocity on the order of about 1,000 ft/sec so as to allow the initial threat detection range to be on the order of about 1,000 fit from the platform 100, as previously described, wherein the platform 100, in such instances, may be an armored ground vehicle or the like. In these instances, the onboard fusing sensors 450, 460 must have a high order of accuracy in order to provide precise timing for deploying the CM 500 and both the one or more detonating devices 600 and the CM 500 must be configured to deploy the CM 500 at a high rate of speed. Thus, an interceptor device 300 effective against a KE threat 200 includes the fusing sensors 450, 460 spaced apart along the axis of the interceptor device 300, as used in other embodiments, but configured to provide increased-accuracy timing for actuating the one or more detonating devices 600 and deploying the CM 500. Such accuracy can be obtained by, for example, ensuring that the detection beams from the fusing sensors 450, 460 are projected in parallel and that the radar devices comprising the fusing sensors 450, 460 have a very high resolution within the detection range. Accordingly, the relative velocity and range of the threat 200 with respect to the platform 100 may be determined with high accuracy.

In these instances, such embodiments of the present invention advantageously implement a CM 500 configured, as shown in FIGS. 7A and 7B, to provide a relatively focused band of outgoing particles 520, wherein one skilled in the art will readily appreciate that such a knife-like or cutting configuration of the particles 520 may be produced using an appropriately configured shape charge for the CM 500, as previously described. Further, the deployed CM 500 preferably has a relatively high radially-outgoing speed, for example, exceeding about 10,000 ft/sec, so as to allow effective interception of the KE threat 200. In some instances, the interceptor device 300 may include more than one CM 500 disposed along the interceptor device 300 to ensure that the threat 300 is impacted in a desired location by the particles 520 or to ensure that the threat 200 is impacted at multiple locations so as to increase the probability of the desired destruction or disruption of the threat 200. Accordingly, with the interceptor device 300 and CM(s) 500 configured in this manner, the likelihood of defeating the armor-piercing capability of the KE threat 200 is increased. According to another advantageous aspect of the present invention, and as will be appreciated by one skilled in the art, the one or more detonating devices 600 can also be disposed with respect to the CM(s) 500 and configured so as to concentrate the deployment of the CM(s) 500 in a particular direction outward of the interceptor device 300 and to increase the amount of particles 520 impacting the KE threat 200, as shown in FIGS. 8A and 8B. For example, the interceptor device 300 may include a plurality of detonating devices 600 distributed about the interior of the CM(s) 500. As such, depending on the location, shown as zones A, B, C, and D in this instance, of the detected threat 200 about the interceptor device 300, the controller 700 may control the actuation of particular detonating devices 600 or the order of actuation of the detonating devices 600 such that the detonating force deploying the CM(s) 500 is concentrated in the direction of the location of the detected threat 200.

Many of the parameters of the embodiments of an interceptor device 300 described herein and within the spirit and scope of the present invention will be readily appreciated by one skilled in the art, but it will also be understood that the interceptor device 300 can take many different forms and that the embodiments disclosed herein are not intended to be limiting or restricting with respect to the possible variants. For example, in addition to the shape of the CM 500 contributing to the shape of the spread of the particles 520 upon deployment of the CM 500, the mass and/or density of the material comprising the CM 500 may also have an effect. More particularly, in the instance of the shape charges described above, a smaller mass of the material or a less dense material may produce a wider band of particles 520 upon deployment of the CM 500, while a larger mass of the material or a denser material will contribute to a narrower band of particles 520. In other instances, the relative effectiveness ("RE") of the explosive force of the one or more detonating devices 600 may also play a role in the shape of the spread of the particles 520. More particularly, an explosive having a low RE, otherwise referred to as a heaving charge, may be more effective in a detonating device 600 for deploying a forward-expanding cone-shaped CM 500 or a CM 500 producing the relatively narrow band of particles 520, as previously described. On the other hand, an explosive having a high RE, otherwise known as a cutting charge, may be more effective in a detonating device 600 for deploying a narrow knife-like or cutting CM 500. However, the exemplary configurations presented herein are not intended to be limiting as many of the foregoing concepts and components may be combined, arranged, or configured in many different manners for addressing a particular feature necessary for the system 10 and/or the intercepting device 300 to effectively intercept and defeat a particular type of threat 200.

Many modifications and other embodiments of the invention set forth herein will come to mind to one skilled in the art to which this invention pertain having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An interceptor device adapted to protect a platform associated therewith against an incoming threat having a trajectory by intercepting the threat in an intercept zone, said interceptor device comprising:

a housing defining an axis;

a countermeasure device operably engaged with the housing;

at least one detonating charge housed by the housing and operably engaged with and capable of deploying the countermeasure device;

a controller device in communication with the at least one detonating charge, the controller device being housed by the housing and configured to be capable of directing the at least one detonating charge to deploy the countermeasure device at least partially radially outward with respect to the axis of the housing and in correspondence with the trajectory of the threat; and a second sensor device operably engaged with the housing and in communication with the controller device, the second sensor device comprising a range-finding apparatus including at least one of a laser detection and ranging device (LADAR), a radio detection and ranging device (RADAR), and a light detection and ranging device (LIDAR), configured to be capable of sensing one of the threat and a range thereof, at least partially radially outward of the housing, and notifying the controller device if the threat is sensed, so as to cause the controller device to direct the at least one detonating charge to deploy the countermeasure device to impact the threat in the intercept zone.

2. An interceptor device according to claim 1, further comprising a first sensor device in communication with the controller device, the first sensor device being configured to be capable of sensing the threat and notifying the controller device thereof.

3. An interceptor device according to claim 2 wherein the controller device is responsive to the first sensor device, if the threat is sensed thereby, so as to direct the at least one detonating charge to deploy the countermeasure device.

4. An interceptor device according to claim 2 further comprising a launching device configured to be capable of interacting with the housing so as to launch the housing in response to and toward the threat.

5. An interceptor device according to claim 4 wherein the launching device is responsive to the first sensor device, if the threat is sensed thereby, to launch the housing in response to and toward the threat.

6. An interceptor device according to claim 2 wherein the first sensor device further comprises at least one of a laser detection and ranging device (LADAR), a radio detection and ranging device (RADAR), and a light detection and ranging device (LIDAR), configured to be capable of determining a range of the threat.

7. An interceptor device according to claim 2 wherein the first sensor device is operably engaged with the housing.

8. An interceptor device according to claim 2 wherein the first sensor device is discretely disposed with respect to the housing.

9. An interceptor device according to claim 1 wherein the second sensor device further comprises at least one range-finding apparatus configured to be capable of sensing the threat within the intercept zone.

10. An interceptor device according to claim 9 wherein the second sensor device further comprises a plurality of range-finding apparatuses arranged with respect to the housing such that each range-finding apparatus is configured to be capable of sensing the threat within an angular range about the housing and such that the plurality of range-finding apparatuses is configured to be capable of sensing the threat at any angle around the axis of the housing.

11. An interceptor device according to claim 1 wherein the second sensor device further comprises a plurality of range-finding apparatuses spaced apart along the axis of the housing and configured so as to be capable of indicating a relative velocity of the threat with respect to the housing and notifying the controller device thereof.

12. An interceptor device according to claim 1 wherein the countermeasure is configured to cooperate with the controller device and the at least one detonating charge to disable the threat upon impact.

13. An interceptor device according to claim 1 wherein the countermeasure is configured to cooperate with the controller device and the at least one detonating charge to asymmetrically detonate the threat upon impact.

14. An interceptor device according to claim 1 wherein the countermeasure is configured to cooperate with the at least one detonating charge such that the countermeasure is deployed substantially symmetrically radially outward of the housing.

15. An interceptor device according to claim 1 wherein the countermeasure is configured to cooperate with the at least one detonating charge such that the countermeasure is deployed asymmetrically radially outward of the housing.

16. A defensive weapon system adapted to protect a platform associated therewith against an incoming threat having a trajectory by intercepting the threat in an intercept zone, said weapon system comprising:

a cuing sensor adapted to be capable of sensing the threat; and an interceptor device in communication with the cuing sensor and adapted to be deployed in response to the threat sensed thereby, the interceptor device comprising:

a housing defining an axis;

a countermeasure device operably engaged with the housing;

at least one detonating charge housed by the housing and operably engaged with and capable of deploying the countermeasure device;

a controller device in communication with the at least one detonating charge, the controller device being housed by the housing and configured to be capable of directing the at least one detonating charge to deploy the countermeasure device at least partially radially outward with respect to the axis of the housing and in correspondence with the trajectory of the threat; and a sensor device operably engaged with the housing and in communication with the controller device, the sensor device comprising a range-finding apparatus including at least one of a laser detection and ranging device (LADAR), a radio detection and ranging device (RADAR), and a light detection and ranging device (LIDAR), configured to be capable of sensing one of the threat and a range thereof, at least partially radially outward of the housing, and notifying the controller device if the threat is sensed, so as to cause the controller device to direct the at least one detonating charge to deploy the countermeasure device to impact the threat in the intercept zone.

17. A system according to claim 16 wherein the cuing sensor is discretely disposed with respect to the interceptor device.

18. A system according to claim 16 wherein the controller device is responsive to the cuing sensor, if the threat is sensed thereby, so as to direct the at least one detonating charge to deploy the countermeasure device.

19. A system according to claim 16 further comprising a launching device configured to be capable of interacting with the interceptor device so as to launch the interceptor device in response to and toward the threat.

20. A system according to claim 19 wherein the launching device is responsive to the cuing sensor, if the threat is sensed thereby, to launch the interceptor device in response to and toward the threat.

21. A system according to claim 16 wherein the cuing sensor further comprises a range-finding apparatus including at least one of a laser detection and ranging device (LADAR), a radio detection and ranging device (RADAR), and a light detection and ranging device (LIDAR), configured to be capable of determining a range of the threat.

22. A system according to claim 16 wherein the sensor device further comprises at least one range-finding apparatus configured to be capable of sensing the threat within the intercept zone.

23. A system according to claim 22 wherein the sensor device further comprises a plurality of range-finding apparatuses arranged with respect to the housing such that each range-finding apparatus is configured to be capable of sensing the threat within an angular range about the housing and such that the plurality of range-finding apparatuses is configured to be capable of sensing the threat at any angle around the axis of the housing.

24. A system according to claim 22 wherein the sensor device further comprises a plurality of range-finding apparatuses spaced apart along the axis of the housing and configured so as to be capable of indicating a relative velocity of the threat with respect to the housing and notifying the controller device thereof.

25. A system according to claim 16 wherein the countermeasure is configured to cooperate with the controller device and the at least one detonating charge to disable the threat upon impact.

26. A system according to claim 16 wherein the countermeasure is configured to cooperate with the controller device and the at least one detonating charge to asymmetrically detonate the threat upon impact.

27. A system according to claim 16 wherein the countermeasure is configured to cooperate with the at least one detonating charge such that the countermeasure is deployed substantially symmetrically radially outward of the housing.

28. A system according to claim 16 wherein the countermeasure is configured to cooperate with the at least one detonating charge such that the countermeasure is deployed asymmetrically radially outward of the housing.

29. A method of intercepting an incoming threat having a trajectory, said method comprising:

launching an interceptor device from a launching device so as to intercept the threat in an intercept zone, the interceptor device comprising:

a housing defining an axis;

a countermeasure device operably engaged with the housing;

at least one detonating charge housed by the housing and operably engaged with and capable of deploying the countermeasure device;

a controller device housed by the housing and configured to be in communication with the at least one detonating charge; and a sensor device operably engaged with the housing and in communication with the controller device, the sensor device comprising a range-finding apparatus including at least one of a laser detection and ranging device (LADAR), a radio detection and ranging device (RADAR), and a light detection and ranging device (LIDAR), configured to be capable of sensing one of the threat and a range thereof, at least partially radially outward of the housing, and notifying the controller device if the threat is sensed; and actuating the at least one detonating charge with the controller device, in response to the sensor device, so as to deploy the countermeasure device at least partially radially outward with respect to the axis of the housing and in correspondence with the trajectory of the threat to thereby cause the countermeasure to impact the threat in the intercept zone.

30. A method according to claim 29 further comprising sensing the incoming threat with a cuing sensor in communication with at least one of the launching device and the controller device.

31. A method according to claim 30 further comprising directing the launching device to launch the interceptor device in response to sensing of the incoming threat by the cuing sensor.

32. A method according to claim 30 further comprising determining, at least partially from the cuing sensor, a time at which the interceptor device and the incoming threat are both in the intercept zone.

33. A method according to claim 32 wherein actuating the at least one detonating charge further comprises actuating the at least one detonating charge, as a function of the time determined at least partially by the cuing sensor, such that the countermeasure impacts the threat in the intercept zone.

34. A method according to claim 30 wherein sensing the incoming threat with a cuing sensor further comprises sensing the incoming threat with a range-finding apparatus including at least one of a laser detection and ranging device (LADAR), a radio detection and ranging device (RADAR), and a light detection and ranging device (LIDAR), configured to be capable of determining a range of the threat.

35. A method according to claim 29 wherein actuating the at least one detonating charge further comprises directing the at least one detonating charge to deploy the countermeasure device in response to and as a function of the range of the threat sensed by the sensor device.

36. A method according to claim 29 further comprising sensing the range of the threat with at least one range-finding apparatus configured to be capable of sensing the threat within the intercept zone.

37. A method according to claim 36 wherein sensing the range of the threat further comprises sensing the range of the threat with a plurality of range-finding apparatuses arranged with respect to the housing such that each range-finding apparatus is configured to be capable of detecting the threat within an angular range about the housing and such that the plurality of range-finding apparatuses is configured to be capable of detecting the threat at any angle around the axis of the housing.

38. A method according to claim 36 wherein sensing the range of the threat further comprises sensing the range of the threat with a plurality of range-finding apparatuses spaced apart along the axis of the housing and configured so as to be capable of indicating a relative velocity of the threat with respect to the housing, and notifying the controller device thereof.

39. A method according to claim 29 wherein actuating the at least one detonating charge further comprises actuating the at least one detonating charge such that the at least one detonating charge cooperates with the countermeasure to disable the threat upon impact.

40. A method according to claim 29 wherein actuating the at least one detonating charge further comprises actuating the at least one detonating charge such that the at least one detonating charge cooperates with the countermeasure to asymmetrically detonate the threat upon impact.

41. A method according to claim 29 wherein actuating the at least one detonating charge further comprises actuating the at least one detonating charge such that the at least one detonating charge cooperates with the countermeasure to deploy the countermeasure substantially symmetrically radially outward of the housing.

42. A method according to claim 29 wherein actuating the at least one detonating charge further comprises actuating the at least one detonating charge such that the at least one detonating charge cooperates with the countermeasure to deploy the countermeasure asymmetrically radially outward of the housing.

* * * * *